US007267241B2

(12) United States Patent
Franzen et al.

(10) Patent No.: US 7,267,241 B2
(45) Date of Patent: Sep. 11, 2007

(54) DEVICE FOR DETERMINING A LOAD ON A HOIST

(75) Inventors: Hermann Franzen, Mönchengladbach (DE); Jannis Moutsokapas, Monheim (DE)

(73) Assignee: Gottwald Port Technology GmbH, Düsseldorf (DE)

( * ) Notice: Subject to any disclaimer, the term of this patent is extended or adjusted under 35 U.S.C. 154(b) by 414 days.

(21) Appl. No.: 10/472,835

(22) PCT Filed: Feb. 6, 2003

(86) PCT No.: PCT/EP03/01191

§ 371 (c)(1),
(2), (4) Date: Sep. 22, 2003

(87) PCT Pub. No.: WO03/066505

PCT Pub. Date: Aug. 14, 2003

(65) Prior Publication Data

US 2004/0104191 A1 Jun. 3, 2004

(30) Foreign Application Priority Data

Feb. 7, 2002 (DE) ..... 102 05 434

(51) Int. Cl.
*B66D 1/48* (2006.01)

(52) U.S. Cl. ..... 212/278; 254/268; 254/275
(58) Field of Classification Search ..... 212/278; 254/268, 275

See application file for complete search history.

(56) References Cited

U.S. PATENT DOCUMENTS 2,025,928 A * 12/1935 Wunsch et al. ..... 73/862.44

(Continued)

FOREIGN PATENT DOCUMENTS

DE 29723821 3/1999

(Continued)

*Primary Examiner*—Thomas J. Brahan
(74) *Attorney, Agent, or Firm*—Henry M. Feiereisen

(57) ABSTRACT

The invention relates to a device for determining a load on a hoist of a crane for handling a container, including rope drum, drive motor as well as hoist transmission disposed between drive motor and rope drum and having a hoist transmission case which is swingably supported about an axis in parallel relationship to the rope drum axis and can be supported on its opposite end on at least one torque support, which a device for indirect determination of the load, suspended from the ropes, is assigned to. In order to create a device for determining a load on a hoist, whereby the load determination is protected from external mechanical influences and effected directly on the rope winch and which device is able to determine the entire load suspended from the ropes as well as also single loads and optionally center of gravity positions of the load, it is proposed that in a hoist with two twin rope drums which are arranged on the same axis and operated in synchronism and which have each a pair of load-carrying ropes which can be spooled and unspooled in a same direction, a load-carrying rope of each pair of load-carrying ropes is guided in a common first load-guiding plane, which extends substantially horizontal and is tangent to the twin rope drums, and routed about deflection rollers into the vertical, and the other two load-carrying ropes of each pair of load-carrying ropes are guided vertically in a common second load-guiding plane which is tangent to the twin rope drums.

10 Claims, 5 Drawing Sheets

U.S. PATENT DOCUMENTS 3,310,291 A * 3/1967 Wiggins ..... 254/268
3,693,939 A * 9/1972 Buckson ..... 254/268
3,837,503 A * 9/1974 Komatsu ..... 212/83
4,047,617 A * 9/1977 Tax et al. ..... 212/278
4,504,023 A * 3/1985 Lauritzen ..... 242/412
4,671,494 A 6/1987 Numata et al.
6,144,307 A 11/2000 Elliot

FOREIGN PATENT DOCUMENTS

GB 2156763 A * 10/1985

* cited by examiner

DEVICE FOR DETERMINING A LOAD ON A HOIST

BACKGROUND OF THE INVENTION

The invention relates to a device for determining a load on a hoist, in particular a hoist of a crane for handling a container, including at least one rope drum, at least one drive motor as well as a hoist transmission disposed between drive motor and rope drum and arranged in a hoist transmission case which is supported on one side of the hoist frame, wherein the hoist transmission case is swingably supported in the area of one of its end faces about an axis in parallel relationship to the rope drum axis and supportable in the area of its other end face on at least one torque support, to which a measuring unit for indirect determination of the load, suspended from the ropes, is associated.

The determination of the load received by the crane is of primary concern if cranes are involved that operate automatically, in particular cranes for handling containers. It contributes to the safety of the crane and thus of the personnel entrusted therewith, so that the crane can be shut down in case of, e.g. overload, serves as scale for ascertaining the load and its load distribution in the ropes, or determines the center of gravity of the load itself, e.g. when the containers are loaded unevenly. Finally, the load determination serves also as indicator for static determination of maintenance periods in connection with the elapsed running time.

Conventional assemblies provide load determination in the rope or in the hoisting device. It is known to measure the axial force in the hoist transmission, caused by the oblique toothing of the spur gears, as proportional variable of the rope force; however, the load measurement is inaccurate and thus has failed. Interfering influences as a result of heat expansion and external temperature impacts can only be compensated in a very complicated technical manner.

According to a conventional technique to determine the load employs the support of the hoist transmission on a torque support. The support force measured hereby on the torque support is proportional to the rope force and thus to the mass suspended from the ropes. The load determination works fairly simple so long as all of the ropes, unspooled from the rope drums, are guided tangentially in the same direction. However, in the event the ropes are paid out in different directions, the conventional load determination is not possible via the torque support.

When several lifting ropes are wound on a common drum, the rope force can be measured in each rope strand. A measuring device is hereby installed on the rope end. Then, the sum of all measured rope forces corresponds to the mass of the load. The measuring device has to be supplied in this case with external energy, preferably electric energy, that has to be transported from the crane to the rope end. The energy lines and also the measuring devices are located directly on the load receiving member. This means, that the energy lines must be protected against external mechanical impacts, causing a significant technical effort that is accompanied with high costs.

SUMMARY OF THE INVENTION

It is an object of the present invention to provide a device for determining a load on a hoist, which realizes the load determination directly on the rope winch while being protected against external mechanical impacts, and which is able to ascertain the entire load suspended from the ropes as well as single loads and, optionally, positions of the center of gravity of the load.

In a hoist with two twin rope drums which are arranged on a same axis and operated in synchronism and which have each a pair of load-carrying ropes which can be wound and unwound in a same direction, it is proposed to solve the object in accordance with the invention by guiding a load-carrying rope of each pair of load-carrying ropes in a common first load-guiding plane which extends substantially horizontal and is tangent to the twin rope drums and routing it about deflection rollers into the vertical, and by vertically guiding the other two load-carrying ropes of each pair of load-carrying ropes in a common second load-guiding plane which is tangent to the twin rope drums.

Guidance of the four load-carrying ropes in two planes oriented substantially transversely to one another is the prerequisite for determining the load on a hoist with four ropes, as used in particular when handling of containers is involved. While two load-carrying ropes of each pair of load-carrying ropes is directly unspooled from and spooled onto the rope drum in vertical direction, the remaining two other load-carrying ropes are initially conducted horizontally and then routed about deflection rollers into the vertical. The twin rope drums are so constructed and supplied that all four ropes are spooled and unspooled simultaneously and in synchronism, when the rope drums are operated via the common transmission. As the housing is swingably articulated on one of its sides and supported on the other side upon a torque support with measuring device, the forces commensurate with the rope forces can easily be ascertained by the measuring device.

In order to acquire a precise determination of the rope forces of all ropes and thus the magnitude of the load suspended from the ropes, it is proposed in accordance with a further feature of the invention to intersect the first and second load-guiding planes in a third plane, which extends through the rotation axis of the twin rope drums and the pivot axis of the hoist transmission and is provided on the side of the transmission case, which side is distal to the deflection rollers and the torque support, and to assign a force transducer to the torque support for determining the total sum of the effective rope forces.

As a consequence of the proposal of the invention, a geometric correlation between the load-guiding planes and thus of the load-carrying ropes as well as the pivot axis of the transmission case is defined, as a result of which the distances from the center of the load-carrying rope to the rotation axis for both ropes, guided in the load-guiding planes, is of same size. Regardless of the individual rope forces in the rope strands, this arrangement realizes that a force transducer integrated in the torque support determines at all times the total sum of the suspended load.

According to another alternative of the present invention, it is provided to dispose the pivot axis on the side of the transmission case, which side is proximal to the deflection rollers and distal to the torque support, to arrange measuring axles in the deflection rollers for determination of the rope forces of the linked load-carrying ropes, which rope forces are effective there in vertical direction, and to permit a determination of the rope forces of the vertically guided other load-carrying ropes by the force transducer of the torque support neighboring the load-carrying ropes.

This solution allows a separate determination of the load-carrying ropes at least in pairs. While the force transducer in the torque support determines the effective force resultant from the directly vertically guided ropes, the rope forces of the other ropes, which are guided initially substantially horizontally and then deflected, can be determined by measuring sensors which are positioned in the axles of the deflection roller. In this way, it is possible to provide more precise information about the load distribution in the rope strands, without requiring an arrangement of the measuring devices in proximity of the load-receiving means, as in the afore-described state of the art.

According to a further embodiment of the present invention, it is provided that the rope forces of the load-carrying ropes, which are guided vertically in the second load-guiding plane, are ascertained in the force transducers of two torque supports disposed in spaced-apart relationship next to the load-carrying ropes, whose geometric disposition in relation to the hoist transmission case and the distances to the load-carrying ropes can be unambiguously determined, whereby the pivot axis of the hoist transmission case permits tilting motions.

This proposed solution enables also, as a consequence of the precise determination of the rope forces, precise information about the center of gravity of the load. The load-carrying ropes trained about the deflection rollers enable in the measuring axles of the deflection rollers a precise determination of the respectively vertically effective rope force in each individual rope. Such a separate load determination is possible for the load-carrying ropes, which are unwound in the vertical load guiding plane directly from the twin rope drum, by employing two torque supports disposed in spaced-apart relationship and provided with pertaining force transducers, which can be ascertained on the hoist transmission case in an exact geometric manner while coupled to the hoist frame. Preferably, the force transducers are arranged on both sides of a vertical center plane through the transmission case in symmetry at a defined distance from one another; their distance to the respective load-carrying rope to be measured is known. As a consequence of the geometric relations, the rope load to be ascertained can easily be determined in the force transducer devices. A determination in both force transducer devices of loads of different magnitudes is an indication for an off-center disposition of the center of gravity. Since the varying rope loads can be determined also on the deflection rollers, the disposition of the center of gravity can be acquired through calculation in a precise manner via the geometric relations and respectively evaluated.

As the distance of the ropes changes in relation to the force transducer devices or torque supports, respectively, as the rope is spooled or unspooled, according to another feature of the invention, it is provided that the variable data of the rope distances are determined electronically in the second load-guiding plane and monitored. This monitoring is known in principle and is used here to receive definite measuring signals for each lifting height.

The invention proposes a load determination on a hoist which is executed directly on the rope winch. The measuring device is thus substantially protected from external measuring influences, and forced accelerations which are encountered at relative measurements with force transducers guided together with the load-receiving means are not experienced. The invention always executes an absolute measurement.

BRIEF DESCRIPTION OF THE DRAWING

An exemplified embodiment of the invention is shown in the drawing and will now be described. It is shown in.

DETAILED DESCRIPTION OF PREFERRED EMBODIMENTS

Figure 1:
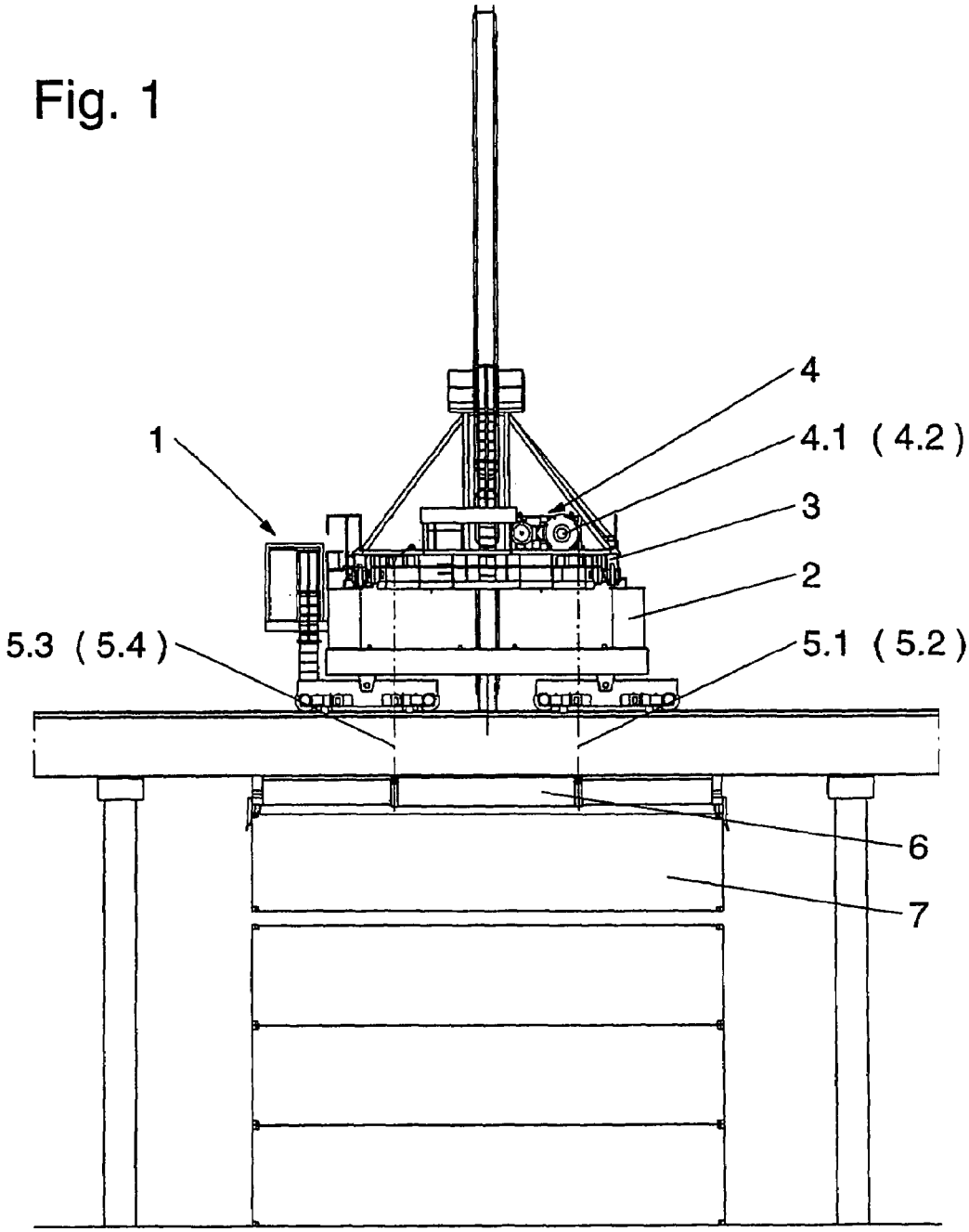
FIG. 1 the view of a crane assembly of the invention.

FIG. 1 shows a simplified illustration of an overall view of a crane assembly which has embodied therein the present invention. The elevated overhead crane 1 includes the bridge 2 and the trolley 3. Guided from the hoist 4 and both twin rope drums 4.1 and 4.2 are respectively two, i.e. total of four, ropes 5.1 to 5.4 to the load-receiving means 6 which carries the load 7. In the shown exemplified embodiment, the load is an ISO container.

Figure 2:
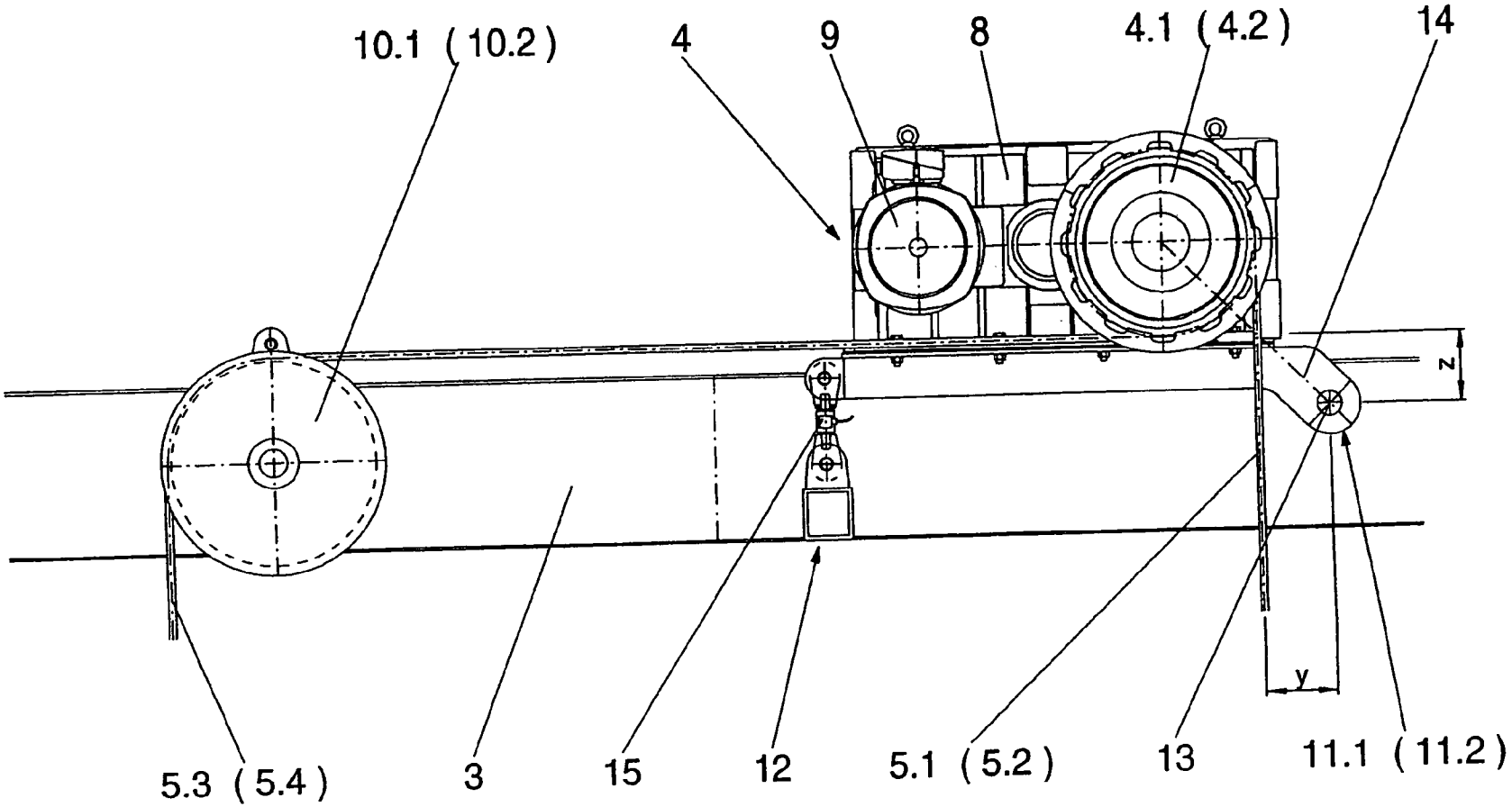
FIG. 2 an embodiment of the device according to the invention for load determination, FIG. 3 a simplified schematic 3D illustration of the hoist according to FIG. 2, FIG. 4 a schematic 3D illustration of a first variation of the embodiment, and FIG. 5 a schematic 3D illustration of a second variation of the embodiment of the invention.

FIG. 2 shows a detailed view, on an enlarged scale, of the hoist 4 on the trolley 3. The hoist 4 includes the transmission 8 with the transmission case, the drive motors 9, both twin rope drums 4.1 and 4.2 as well as both deflection rollers 10.1 and 10.2. The transmission case 8 is supported within the trolley 3 on both transmission bearings 11.1 and 11.2 and the torque support 12.

As can be seen, the load-carrying ropes 5.3 and 5.4 are guided in a first horizontal load-guiding plane between the twin rope drums 4.1 and 4.2, respectively, and the deflection rollers 10.1 and 10.2, respectively, while the load-carrying ropes 5.1 and 5.2 are guided directly by the load drums 4.1 and 4.2 vertically in a common vertical second load-guiding plane. The pivot axis 13 of the transmission case 8 extends through both transmission bearings 11.1 and 11.2; it is oriented hereby in a plane 14 which extends through the intersection of both rope guiding planes, on one hand, and the rotation axis of the rope drums 4.1 and 4.2. In the shown vertical and horizontal rope run-off, the dimensional distances of rope center to the pivot axis 13 remain in these geometric relations of same size, i.e. y equals z.

This illustrated arrangement of the hoist ensures that the force transducer 15, integrated in the torque support 12, acquires the total sum of the load, irrespective of the individual rope forces in the rope strands 5.1 to 5.4. However, this arrangement is not able to provide information about the center of gravity of the load 7.

Figure 3:
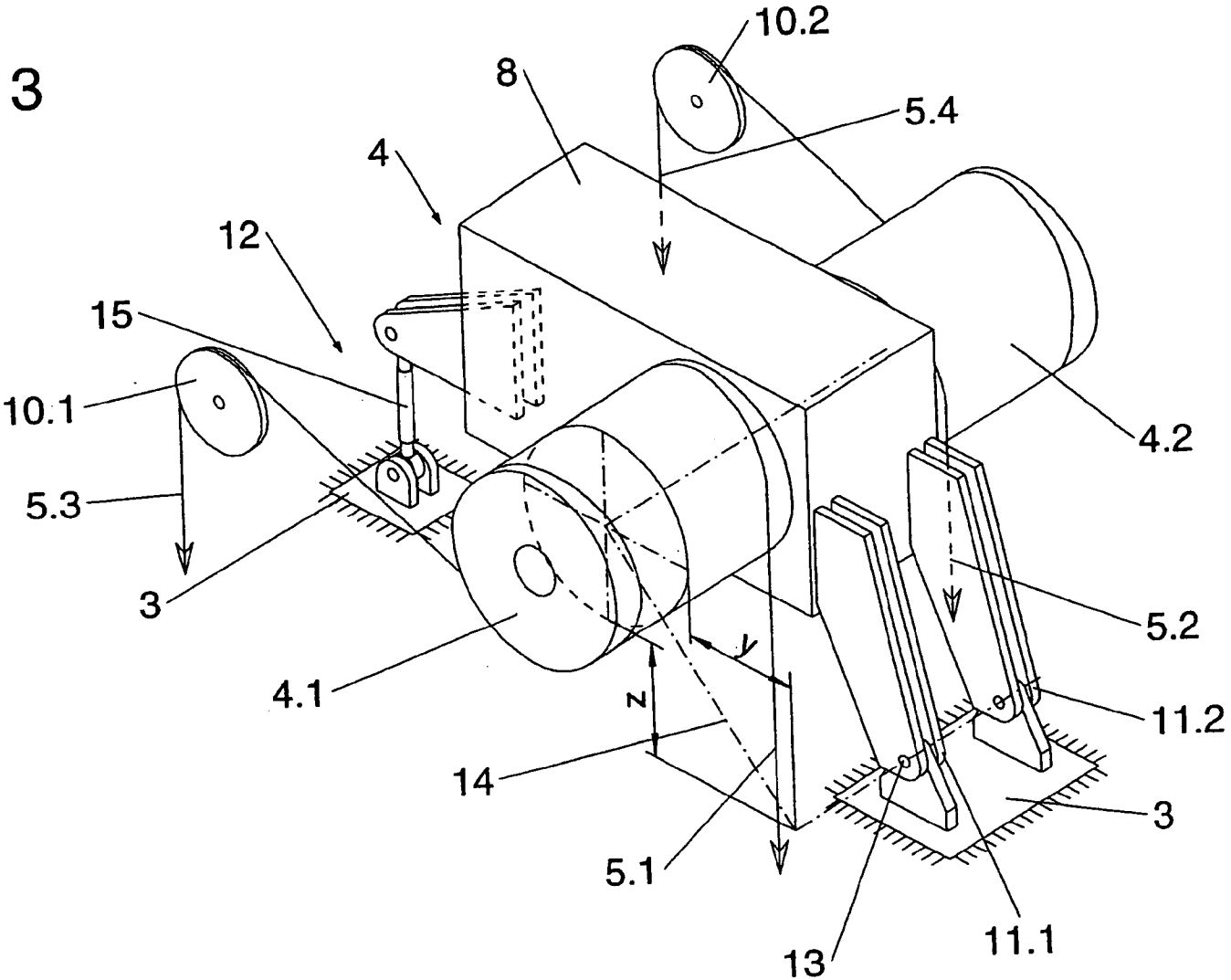

The afore-described solution is shown again in FIG. 3 in a simplified geometric way by a schematic 3D illustration. Depicted are the hoist 4, both twin rope drums 4.1 and 4.2 and both deflection rollers 10.1 and 10.2. The transmission case 8 is supported within the trolley 3 by the pivot axis 12, extending through the transmission bearings 11.1 and 11.2, as well as by the torque support 12 as to be supported by three bearing points. The pivot axis 13 lies hereby in the third plane 14, shown by dash-dot line and extending through the intersection of both load-guiding planes and the rotation axis of the rope drums 4.1 and 4.2. As described, the dimensional distances of rope center to the rotation axis 13 remains of same size, i.e. y equals z, wherein y defines the distance from load-carrying rope 5.1 to the pivot axis 13, and z the distance from load-carrying rope 5.3 to pivot axis 13. The same is true for the load-carrying ropes 5.2 and 5.4 of the other twin rope drum. The force transducer 15, integrated in the torque support 12 and not shown in detail, determines in this arrangement the total sum of the load, regardless of the individual rope forces in the rope strands 5.1 to 5.4.

Figure 4:
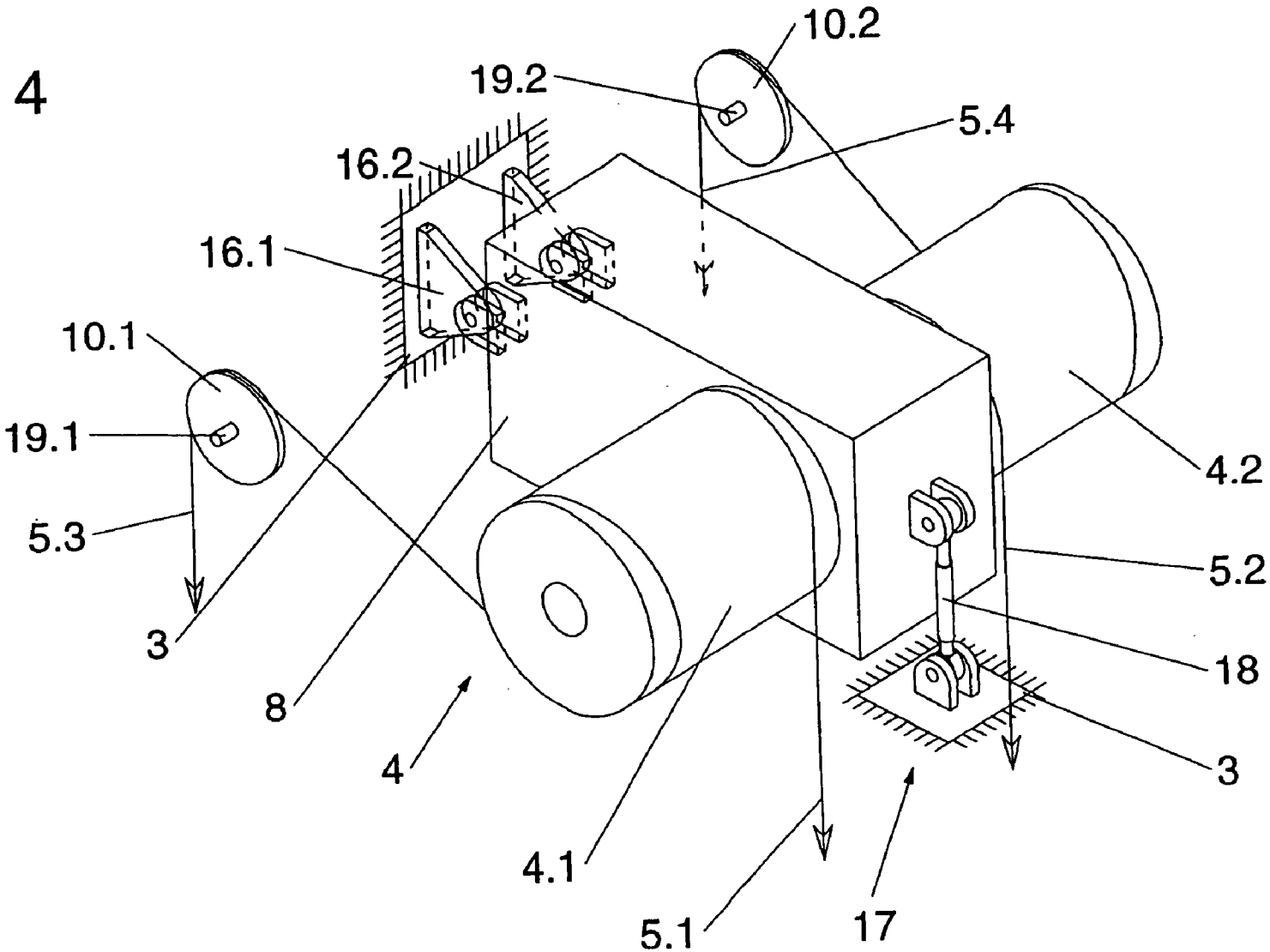

A further alternative of the invention is shown in FIG. 4. The hoist 4 can be seen in a schematic 3D illustration by way of the two twin rope drums 4.1 and 4.2 and the defection rollers 10.1 and 10.2. The transmission case 8 is supported within the trolley 3 by the two transmission bearings 16.1 and 16.2 as well as by the torque support 17 as to be supported by three bearing points. The rope forces in the load-carrying ropes 5.3 and 5.4 are ascertained via the measuring axles 19.1 and 19.2 in the deflection rollers 10.1 and 10.2. The force transducer 18 integrated in the torque support 17 determines the sum of the load from the single vertically effective rope forces in the rope strands 5.1 and 5.2. This solution thus enables a separate determination of the rope forces on both sides of the transmission. This arrangement does not provide information about the center of gravity of the load 7.

Figure 5:
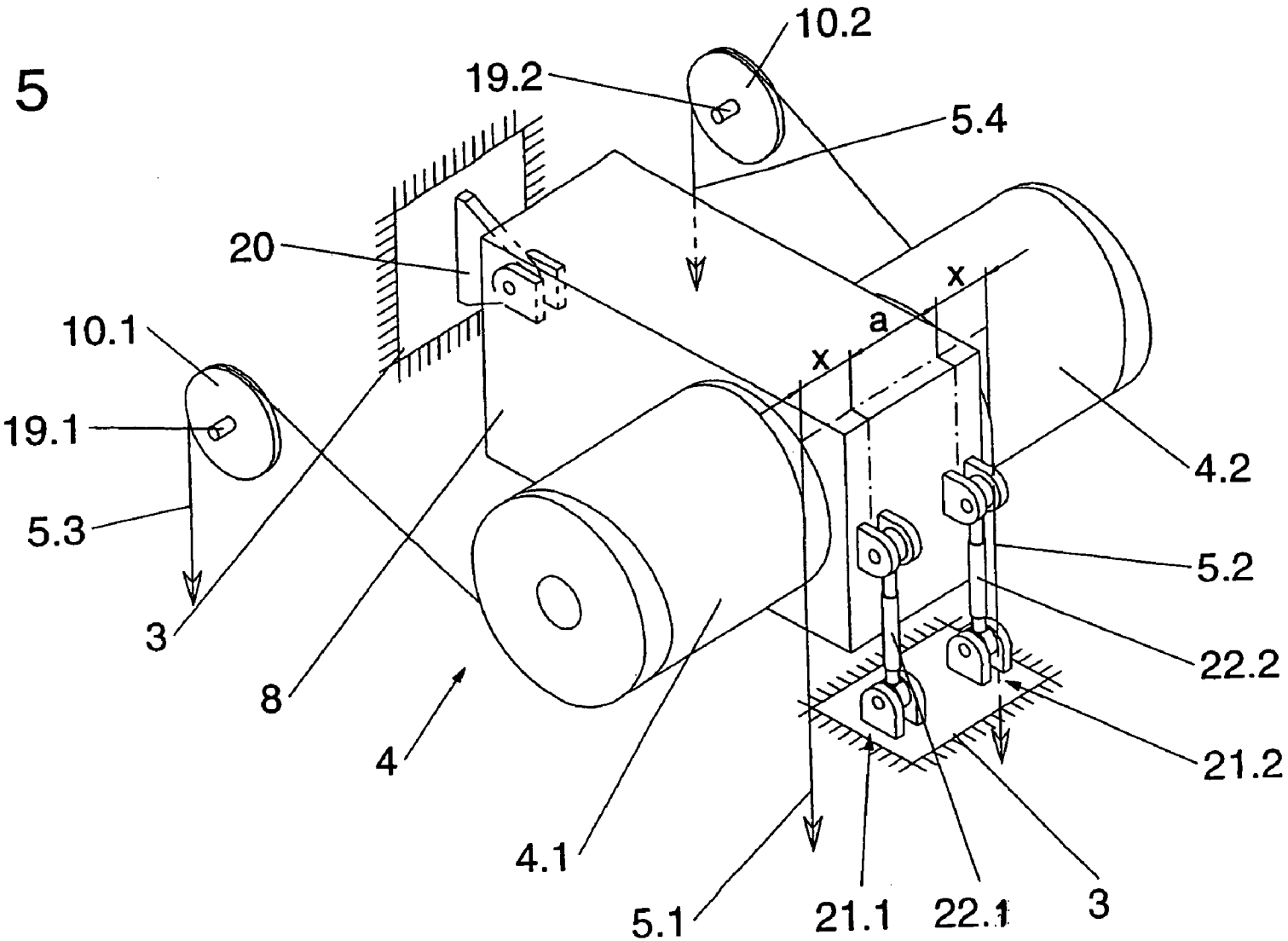

The illustration in FIG. 5 shows a further alternative of the invention. The hoist 4 is also here designated with 4. Both twin rope drums are labeled with reference numerals 4.1 and 4.2. The load-carrying ropes 5.3 and 5.4 are guided about the deflection rollers 10.1 and 10.2, which, like in the solution according to FIG. 4, are provided with measuring axles 19.1 and 19.2 and allow a separate determination of the rope forces in the rope strands 5.3 and 5.4. The transmission case 8 is supported within the trolley 3 by the transmission bearing 20 and both torque supports 21.1 and 21.2. Provided in the torque supports 21.1 and 21.2 are integrated force transducers 22.1 and 22.1 which ascertain individually the vertically effective rope forces. The following data are known:

The constant measuring values in the force transducers 22.1 and 22.2, the constant torque support distance a, the geometry of the groove profile of the rope drum, the dimensional distances X dependent on the respective lifting height and changing during winding and unwinding of the ropes. These variable data are electronically transmitted and monitored, as is known from the state of the art.

The rope forces in the rope strands 5.3 and 5.4 are determined separately, so that all rope forces of each single rope strand 5.1 to 5.4 are now known and can be evaluated. The precise determination of these rope forces enables in this arrangement of the hoist support information about the position of the center of gravity of the load 7.

What is claimed is:

1. A device for determining a load on a hoist, comprising:

at least one drive motor;

two twin rope drums arranged on a common axis and operated by the drive motor in synchronism, each of the rope drums having a pair of load-carrying ropes which can be spooled and unspooled in a same direction, wherein one of the load-carrying ropes of each pair of load-carrying ropes is guided in a common first load-guiding plane, extending substantially horizontal and tangent to the twin rope drums, and is routed about deflection rollers into the vertical, and wherein the other one of the load-carrying ropes of each pair of load-carrying ropes is guided vertically in a common second load-guiding plane which is tangent to the twin rope drums;

a common hoist transmission disposed between the drive motor and the rope drums and arranged in a hoist transmission case;

three bearing points for supporting the hoist transmission case for rotation about a pivot axis in parallel relationship to the common axis of the rope drums; and a measuring device for indirect determination of a load that is suspended from the load-carrying ropes based on said rotation.

2. The device of claim 1, wherein the transmission case has one side distal to the deflection rollers, said first and second load-guiding planes intersecting in a third plane, which extends through the common axis of the twin rope drums and the pivot axis of the hoist transmission case, said third plane being located on said side of the transmission, wherein the measuring device includes a force transducer for determining a total sum of effective rope forces.

3. The device of claim 1, wherein the transmission case has a side which is proximal to the deflection rollers and distal to the torque support, said pivot axis being provided on said side of the transmission case wherein the measuring device includes measuring axles arranged in the deflection rollers for determination of rope forces of the one of the load-carrying ropes, which forces are effective there in vertical direction, wherein the torque support is disposed in an area of the other load-carrying ropes, with rope forces of the other load-carrying ropes determined by a force transducer integrated in the torque support.

4. The device of claim 1, and further comprising a second of said torque support, with the torque supports disposed in spaced-apart relationship next to the other load-carrying ropes, wherein the measuring device includes two force transducers, one force transducer integrated in one of the torque supports and the other one of the force transducers integrated in the other one of the torque supports, wherein rope forces of the other load-carrying ropes are determined in the force transducers of the torque supports on the basis of a known geometric disposition of the torque supports in relation to the transmission case and a known distance of the torque supports to the load-carrying ropes, wherein the pivot axis of the transmission case permits tilting motions.

5. The device of claim 1, wherein the measuring device includes a force transducer integrated in the torque support and constructed to determine a total sum of forces applied upon the load-carrying ropes.

6. The device of claim 1, further comprising two measuring axles, one measuring axle connected to one of the deflection rollers, and the other measuring axle connected to the other one of the deflection rollers, for determining the load suspended from the first ones of the load-carrying ropes, and a force transducer integrated in the torque support for determining the load suspended from the second ones of the load-carrying ropes.

7. The device of claim 5, and further comprising a second of said torque support with integrated force transducer, with the torque supports disposed in spaced-apart relationship next to the second ones of the load-carrying ropes for separately determining the load suspended from the second ones of the load-carrying ropes.

8. The device of claim 6, wherein the force transducers are arranged in symmetry with respect to a housing axis at a predetermined distance to the second ones of the load-carrying ropes, thereby providing information about a position of the center of gravity of the load.

9. The device of claim 1, wherein the three-point bearing includes two transmission bearings in an area of one end face of the hoist transmission case, and a torque support, associated to the measuring device, for support of the hoist transmission case in an area of another end face thereof.

10. The device of claim 1, wherein the three-point bearing includes a transmission bearing in an area of one end face of the hoist transmission case, and two torque supports, associated to the measuring device, for support of the hoist transmission case in an area of another end face thereof.

* * * * *